US007832339B2

(12) United States Patent
Richard

(10) Patent No.: US 7,832,339 B2
(45) Date of Patent: Nov. 16, 2010

(54) AUTOMATIC CABLE CAR FACILITY

(75) Inventor: Jerome Richard, Saint Ismier (FR)

(73) Assignee: Ropetrans AG, Rotkreuz (CH)

( * ) Notice: Subject to any disclaimer, the term of this patent is extended or adjusted under 35 U.S.C. 154(b) by 58 days.

(21) Appl. No.: 12/294,556

(22) PCT Filed: Mar. 29, 2007

(86) PCT No.: PCT/FR2007/000544

§ 371 (c)(1),
(2), (4) Date: Sep. 25, 2008

(87) PCT Pub. No.: WO2007/118975

PCT Pub. Date: Oct. 25, 2007

(65) Prior Publication Data

US 2009/0107357 A1 Apr. 30, 2009

(30) Foreign Application Priority Data

Apr. 4, 2006 (FR) ..... 06 02930

(51) Int. Cl.
*B61B 12/00* (2006.01)

(52) U.S. Cl. ..... 104/173.1; 104/178; 104/179; 104/184; 104/193

(58) Field of Classification Search ..... 104/173.1, 104/178, 179, 184, 193
See application file for complete search history.

(56) References Cited

U.S. PATENT DOCUMENTS 3,902,427 A * 9/1975 Kastenbein ..... 104/127
3,987,734 A * 10/1976 Horn ..... 104/88.03
4,111,130 A * 9/1978 Rodot ..... 104/28
4,394,837 A * 7/1983 Edwards ..... 104/28
4,473,011 A * 9/1984 Wuschek ..... 104/173.1
4,627,361 A * 12/1986 Tarassoff ..... 104/28
4,662,285 A * 5/1987 Rossignol ..... 104/173.2
4,669,389 A * 6/1987 Tarassoff ..... 104/173.2
4,697,169 A * 9/1987 Bertrand ..... 340/540
4,712,486 A * 12/1987 Tarassoff ..... 104/173.1
4,744,306 A * 5/1988 Kunczynski ..... 104/168
4,794,864 A * 1/1989 Feuz et al. ..... 104/168
4,843,970 A * 7/1989 Feuz ..... 104/27
5,012,918 A * 5/1991 Acker et al. ..... 198/465.4

(Continued)

FOREIGN PATENT DOCUMENTS

DE 2347994 A1 4/1975

(Continued)

*Primary Examiner*—S. Joseph Morano
*Assistant Examiner*—Jason C Smith
(74) *Attorney, Agent, or Firm*—The Webb Law Firm

(57) ABSTRACT

Automatic cable transport facility along a closed loop line, including vehicles that can be disengaged at a set rate in stations after moving along a disengaged circuit where they are driven at low speed along disembarkation and embarkation platforms. Each station includes an automatic control mechanism able to extract the vehicles from the slow progression in the disengaged circuit, and transfer them to a disembarkation/embarkation point which is assigned to them in order of arrival, the previous vehicle having previously been reintegrated into the slow progression line in the place of the vehicle extracted in accordance with a preset program. A compensation point includes a permanently available spare empty vehicle which can be used to fill an empty space left by a vehicle that has been delayed and stopped at the disembarkation/embarkation point.

15 Claims, 11 Drawing Sheets

U.S. PATENT DOCUMENTS

| | | | | | |
|---|---|---|---|---|---|
| 5,069,140 | A * | 12/1991 | Glassey | 104/28 |
| 5,105,745 | A * | 4/1992 | Tarassoff | 104/179 |
| 5,119,733 | A * | 6/1992 | Brochand | 104/112 |
| 5,172,640 | A * | 12/1992 | Cathiard | 104/173.2 |
| 5,562,040 | A * | 10/1996 | Egli | 104/173.1 |
| 5,575,215 | A * | 11/1996 | Egli et al. | 104/99 |
| 5,873,310 | A * | 2/1999 | Creissels et al. | 104/173.2 |
| 6,202,563 | B1 * | 3/2001 | Tarassoff et al. | 104/28 |
| 6,427,601 | B2 * | 8/2002 | Albrich | 104/87 |
| 6,729,241 | B2 * | 5/2004 | Gabriel et al. | 104/173.1 |
| 7,004,077 | B2 * | 2/2006 | Meindl | 104/173.1 |
| 7,559,281 | B2 * | 7/2009 | Huard et al. | 104/173.1 |
| 2004/0011240 | A1 * | 1/2004 | Gabriel et al. | 104/173.1 |
| 2005/0081738 | A1 * | 4/2005 | Meindl | 104/173.1 |
| 2006/0252562 | A1 * | 11/2006 | Anderson et al. | 472/32 |
| 2007/0034105 | A1 * | 2/2007 | Mugnier | 104/178 |
| 2008/0148989 | A1 * | 6/2008 | Moritzhuber | 104/173.1 |
| 2009/0107357 | A1 * | 4/2009 | Richard | 104/117.1 |
| 2010/0018434 | A1 * | 1/2010 | Moritzhuber et al. | 104/178 |

FOREIGN PATENT DOCUMENTS

| | | | |
|---|---|---|---|
| EP | 0312497 | A1 | 4/1989 |
| FR | 2692858 | A1 | 12/1993 |

* cited by examiner

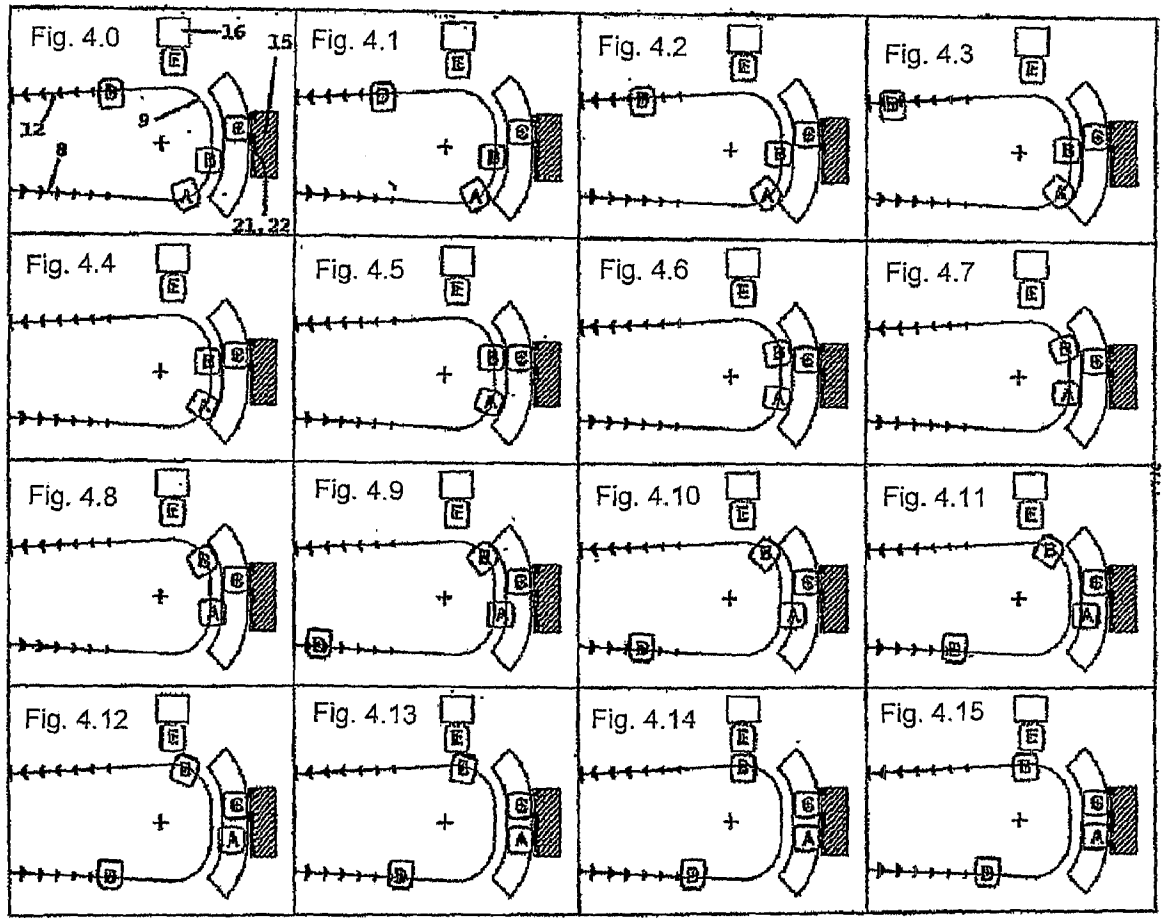
Fig. 4.0
Fig. 4.1
Fig. 4.2
Fig. 4.3
Fig. 4.4
Fig. 4.5
Fig. 4.6
Fig. 4.7
Fig. 4.8
Fig. 4.9
Fig. 4.10
Fig. 4.11
Fig. 4.12
Fig. 4.13
Fig. 4.14
Fig. 4.15
16
15
21, 22
9
8
12

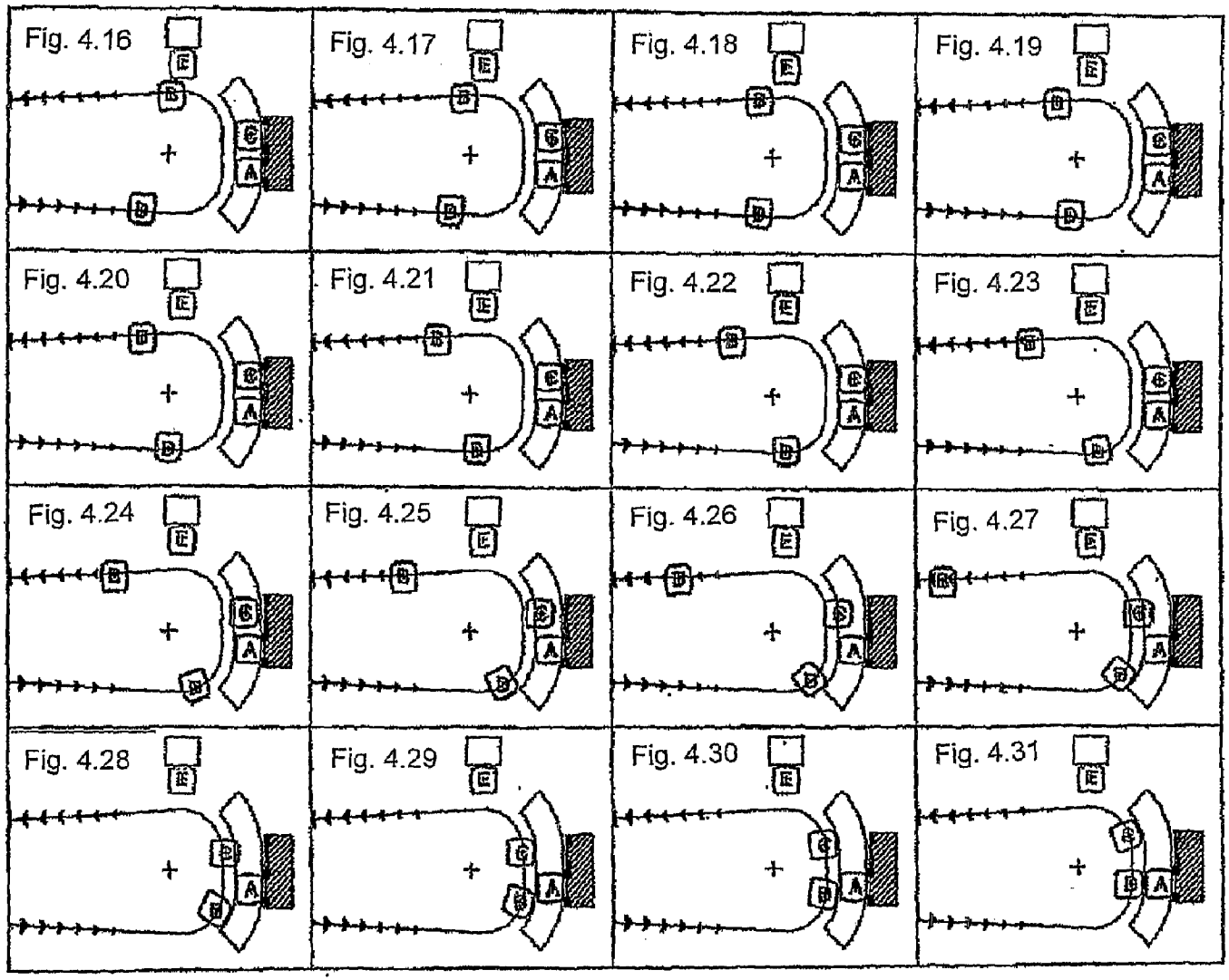
Fig. 4.16
Fig. 4.17
Fig. 4.18
Fig. 4.19
Fig. 4.20
Fig. 4.21
Fig. 4.22
Fig. 4.23
Fig. 4.24
Fig. 4.25
Fig. 4.26
Fig. 4.27
Fig. 4.28
Fig. 4.29
Fig. 4.30
Fig. 4.31

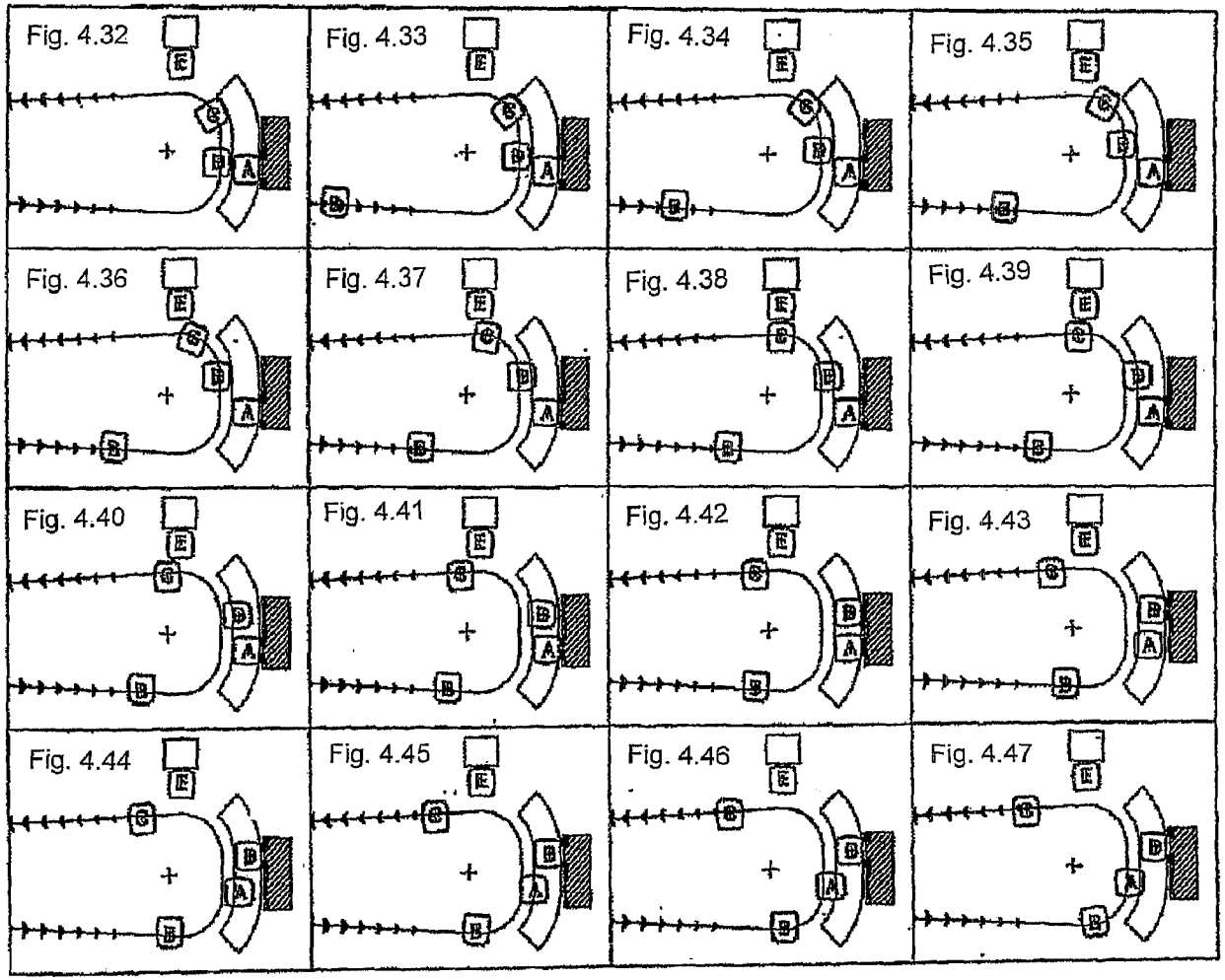
Fig. 4.32
Fig. 4.33
Fig. 4.34
Fig. 4.35
Fig. 4.36
Fig. 4.37
Fig. 4.38
Fig. 4.39
Fig. 4.40
Fig. 4.41
Fig. 4.42
Fig. 4.43
Fig. 4.44
Fig. 4.45
Fig. 4.46
Fig. 4.47

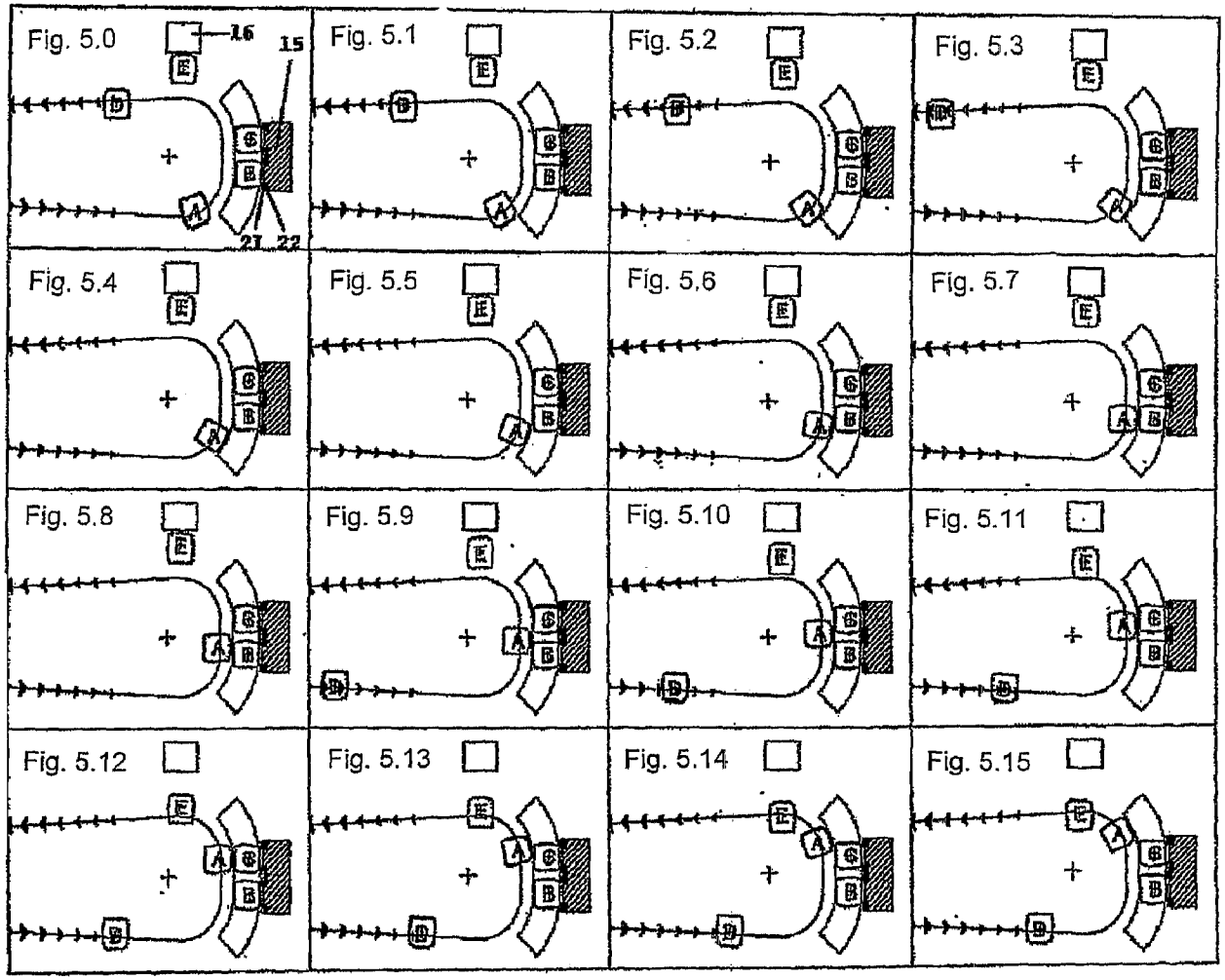
Fig. 5.0
15
16
21
22
Fig. 5.1
Fig. 5.2
Fig. 5.3
Fig. 5.4
Fig. 5.5
Fig. 5.6
Fig. 5.7
Fig. 5.8
Fig. 5.9
Fig. 5.10
Fig. 5.11
Fig. 5.12
Fig. 5.13
Fig. 5.14
Fig. 5.15

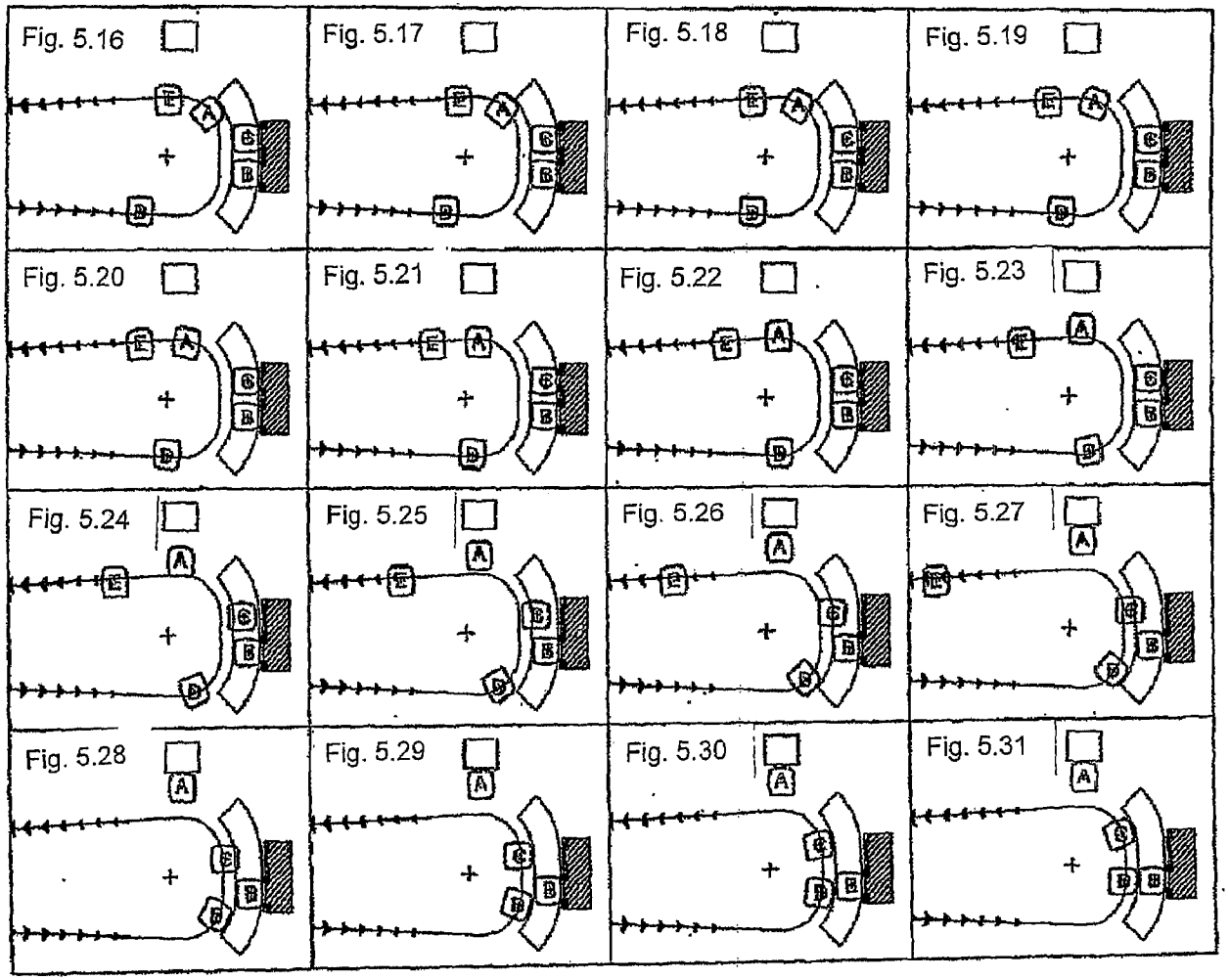
Fig. 5.16
Fig. 5.17
Fig. 5.18
Fig. 5.19
Fig. 5.20
Fig. 5.21
Fig. 5.22
Fig. 5.23
Fig. 5.24
Fig. 5.25
Fig. 5.26
Fig. 5.27
Fig. 5.28
Fig. 5.29
Fig. 5.30
Fig. 5.31

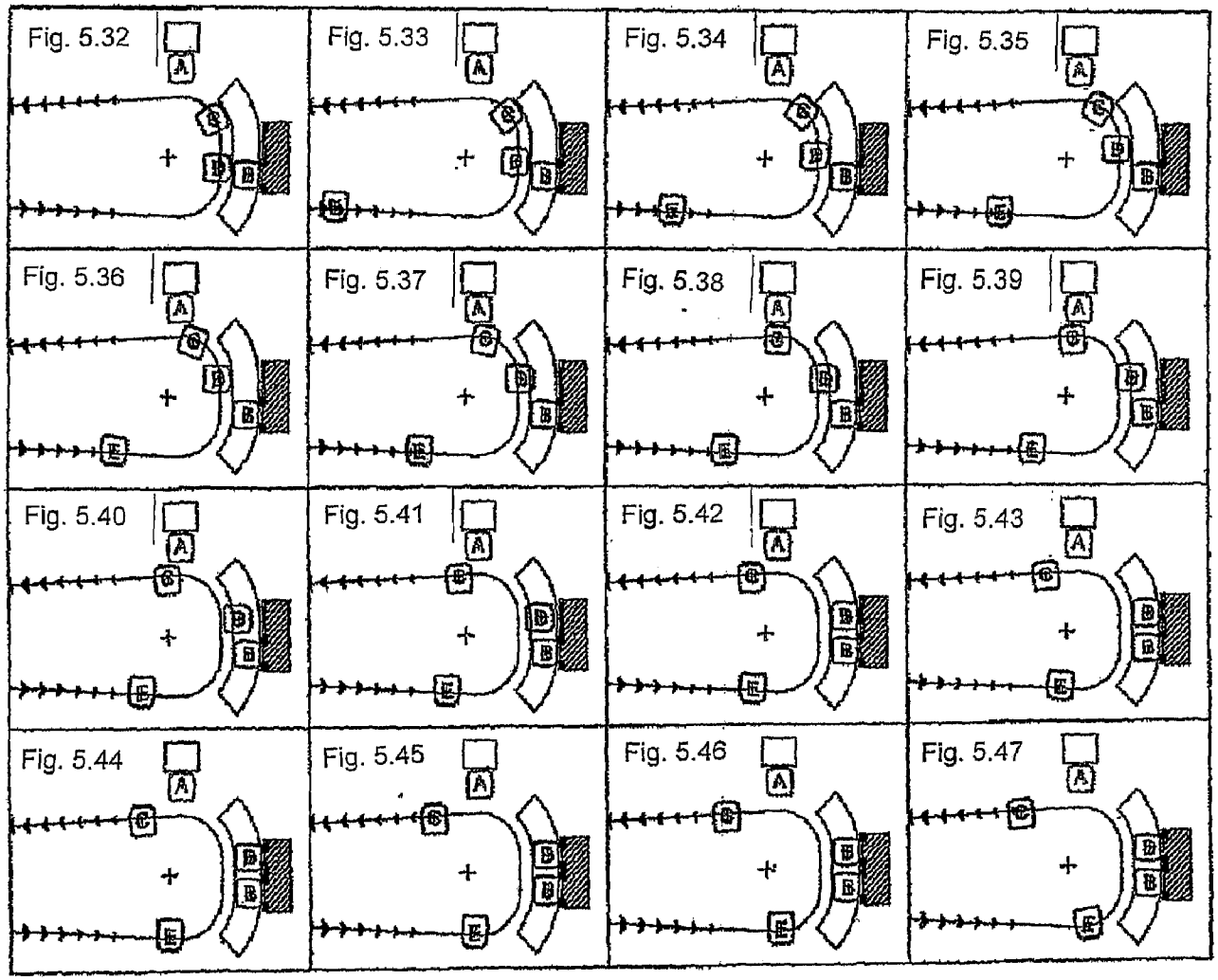
Fig. 5.32
Fig. 5.33
Fig. 5.34
Fig. 5.35
Fig. 5.36
Fig. 5.37
Fig. 5.38
Fig. 5.39
Fig. 5.40
Fig. 5.41
Fig. 5.42
Fig. 5.43
Fig. 5.44
Fig. 5.45
Fig. 5.46
Fig. 5.47

AUTOMATIC CABLE CAR FACILITY

TECHNICAL FIELD OF THE INVENTION

The present invention relates to an automatic cable transport installation along a closed loop line, comprising releasable vehicles timed in stations or in an intermediate station after passing over a released circuit where they are driven at slow speed along drop-off and pick-up platforms, the vehicles then being reaccelerated and recoupled to the cable at the exit of the station in order to constitute an endless stream of vehicles.

PRIOR ART

Many automatic transport means are known, that is to say that operate without the need for the permanent presence of supervision personnel at the drop-off and pick-up of the passengers (or the materials).

The most common of them is the elevator having a virtually total safety and with a minimum of operating problems.

There also exist many people transporters and automatic funicular railways furnished with an operation that is back-and-forth, back-or-forth, or that has a considerable gap between the vehicles. Exceeding a predetermined drop-off and/or pick-up time results in a delay specific to the only vehicle concerned.

The problem is different when such a delay affects a vehicle forming part of an endless stream of vehicles which, if no particular arrangement has been provided, is forced to stop in order to wait for the delayed vehicle. All the vehicles in the line are then stopped to the detriment of the efficiency of the installation and this is likely to cause a reaction of the passengers when it involves passenger transport.

OBJECT OF THE INVENTION

The object of the present invention consists in producing an automatic installation for the transport of vehicles by cable, allowing vehicles released in stations to exceed the allocated time for drop-off and/or pick-up in stations, without affecting the smoothness of operation of the endless stream of the other vehicles that are in the line and in stations.

The installation is characterized in that each station comprises an automatic maneuvering mechanism capable of extracting the vehicles from the slow path in the released circuit, and of transferring them to a drop-off/pick-up position that is assigned thereto in order of arrival, the previous vehicle having been previously reincorporated into the slow path in place of the extracted vehicle according to an established program.

In order to maintain the continuous operation of the endless stream of vehicles in the line, irrespective of the time allocated to the drop-off/pick-up of a vehicle released in a station, any vehicle exceeding the drop-off/pick-up time allocated thereto will not block the path of the other released vehicles. Drop-off/pick-up takes place at positions situated outside said path, that is to say that the released vehicles are systematically extracted from the normal path, during drop-off and pick-up, and are then retrieved.

The endless stream of the vehicles in the line is not affected, with only a "hole" in the line corresponding to the absence of the delayed vehicle which is immobilized at an off-path position in a station. To return to the normal endless stream, the delayed vehicle is reinserted one circuit afterwards in the gap that its absence has created. It is also possible to put the endless stream out of time over a certain number of vehicles in order to insert the delayed vehicle therein, and the normal timing is then resumed by operating on the relative speeds of the vehicles released in the other station.

Each station is also furnished with at least one compensation position in which there is permanently an empty reserve vehicle capable of filling an empty space left by a vehicle delayed and stopped at the pick-up/drop-off position. If, for any reason, a vehicle that has to be reinserted into the path is not ready to depart, it remains in its position thereby creating a gap in the path, a gap that will be immediately filled by one of the available reserve vehicles, thereby reconstituting the timing of the installation.

The compensation position is provided only for the drop-off of the passengers from a vehicle that would have had to go to the pick-up/drop-off position occupied by another delayed vehicle that has not been able to be reinserted in its place in time.

The maneuvering mechanism for the extractions and reinsertions of vehicles may comprise various mechanical control members, particularly horizontal sidings, vertical or inclined elevators, level points bringing the vehicles to appropriate tracks.

The compensation positions are situated downstream of the drop-off/pick-up positions relative to the direction of the slow path of the vehicles.

The drop-off/pick-up of the passengers is carried out when stopped, each vehicle stopping at its drop-off/pick-up position in front of a platform, which is furnished with a landing door placed opposite the door of the vehicle that is stopped. The opening and closing of the doors of the vehicles and of the landing doors is automatic and simultaneous.

BRIEF DESCRIPTION OF THE DRAWINGS

Other advantages and features will emerge more clearly from the following description of particular embodiments of the invention given as nonlimiting examples and represented in the appended drawings, wherein:

FIGS. 4.0 to 4.47 represent the successive phases of a normal operation of the installation with vehicles A, B, C, D entering the station, the vehicle E being the reserve vehicle in the compensation position;

FIGS. 5.0 to 5.47 illustrate the sequence of an exceptional operation of the system when the drop-off/pick-up in a vehicle exceeds the time allocated thereto;

DESCRIPTION OF PARTICULAR EMBODIMENTS

Figure 1:
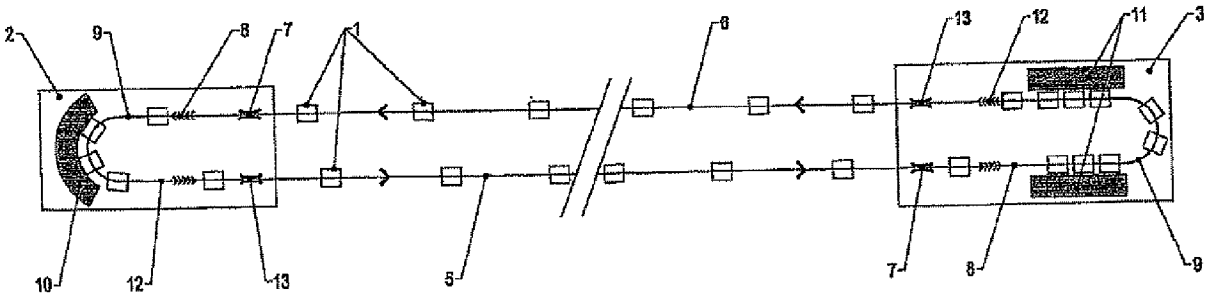
FIGS. 1 and 2 are schematic views of a releasable cable car installation with one and two segments.
Figure 2:
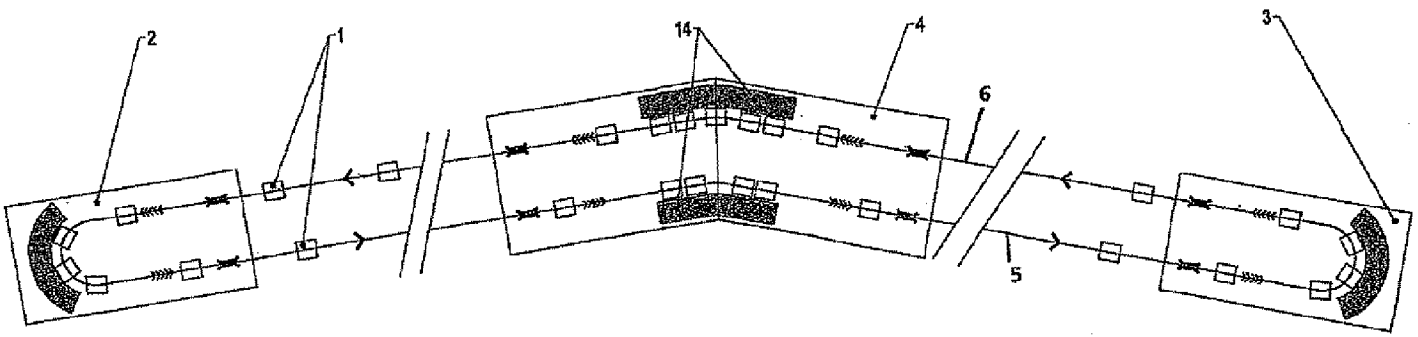

With reference to FIGS. 1 and 2, a plurality of vehicles 1 move on a track 5 in a closed loop from a first station 2 to a second station 3, if necessary with an intermediate station 4 (FIG. 2). The vehicles 1 return in the reverse direction over another parallel track 6 thanks to one or more carrier or puller cable(s) in the case of a cable car, or any other track and means of traction for other types of conveyors.

Between the various stations 2, 3, 4 of the loop, the vehicles 1 move at great speed, for example at several meters per second, and are distributed evenly, with reduced time intervals of the order of a few seconds.

On entering one of the end stations 2, 3, the vehicles 1 are released from the cables at the releasing zone 7, and then are decelerated over a certain length in the deceleration zone 8. They then travel at slow speed along a released circuit furnished with a contour 9 turning them round, and pass, depending on the type of stations, in front of drop-off and pick-up platforms 10, 11 situated either in the contour 9, or in lateral rectilinear portions.

At the end of their slow path in the released circuit, the vehicles 1 are reaccelerated in the acceleration zone 12 and recoupled to the cable in the engagement zone 13 at the exit of the station.

In an intermediate station 4 (FIG. 2) traversed by the vehicles 1, the drop-off and pick-up platforms 14 extend laterally along the tracks 5, 6, the vehicles 1 being, as in the end stations 2, 3, released, slowed down before passing in front of the platforms, and then accelerated and engaged afterwards.

In the case of FIGS. 1 and 2, the drop-off and pick-up platforms 10, 11 and 14 are situated close to the main circuit of the released tracks, and are used by the passengers when getting on or getting off. This is the conventional operation of the releasable cable car installations with a continuous path along the track.

Figure 3:
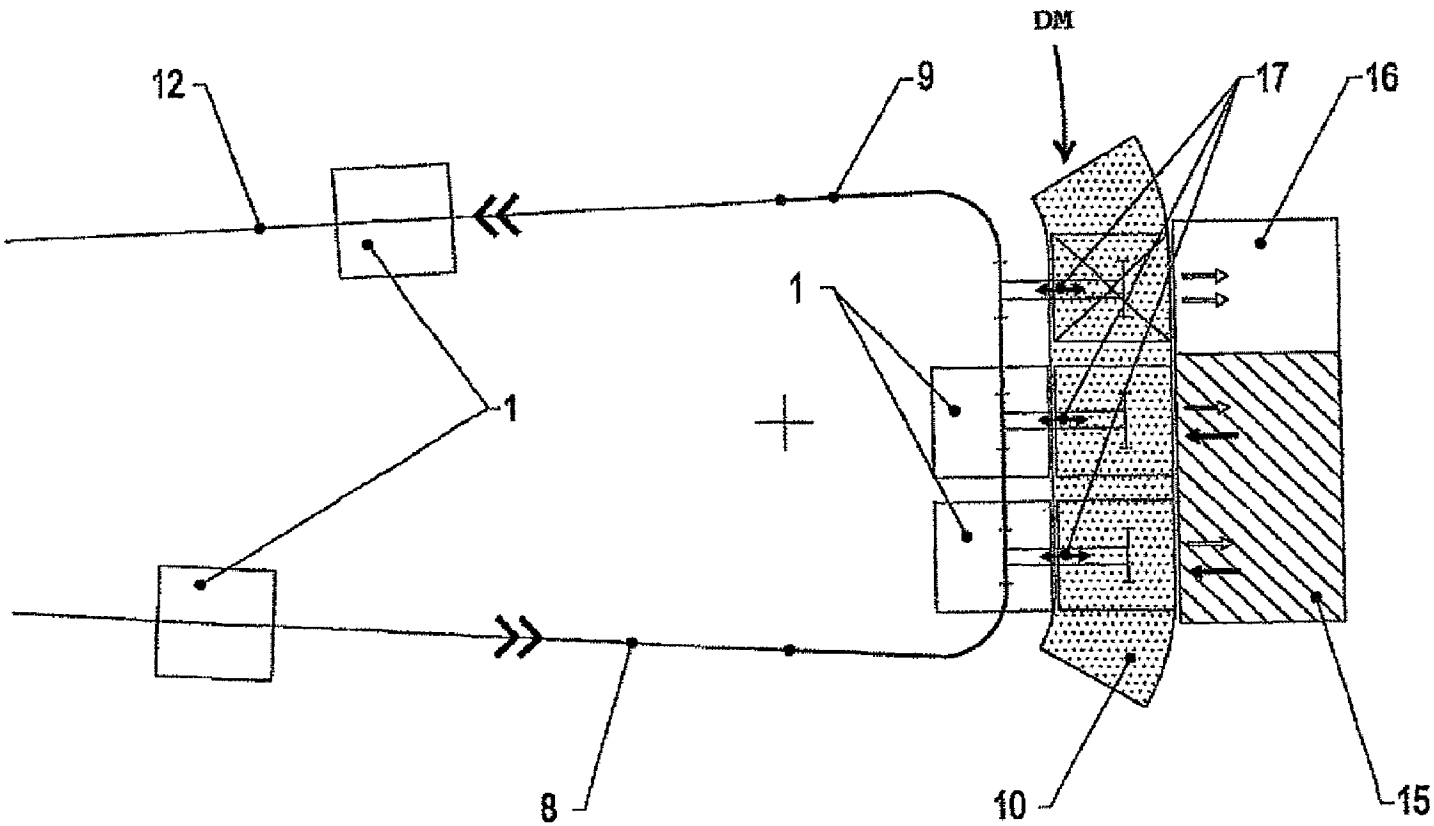
FIG. 3 shows a schematic view of an end station of an automatic installation fitted with an operating device with actuation sidings according to the invention.

In an automatic installation of cable cars or other releasable vehicles 1 that are timed without supervision, the end station illustrated in FIG. 3 is fitted with an automatic maneuvering mechanism DM in order to carry out the extraction and reinsertion of the released vehicles 1 in the contour 9. The maneuvering device DM comprises horizontal actuation sidings 17, making it possible to move the vehicles 1 in a direction across the direction of travel, so as to extract them from the normal path for the drop-off and return them to the circuit at the end of a predetermined time after pick-up. The extracted vehicles 1 are stored off-line in the location of the platform 10, and their access doors are then placed in front of two drop-off and pick-up positions 15 and a compensation position 16. The passengers are dropped off and picked up exclusively when the vehicles 1 are stopped.

The compensation position 16 is only provided for dropping off the passengers, because it has to receive the vehicle which would have had to go to a position occupied by another vehicle that had not been inserted into the circuit in time. In the compensation position 16, there is therefore permanently an empty vehicle ready to fill the gap in the event of a timing fault in the line. The installation may have several compensation positions 16, up to a number equal to that of the drop-off and pick-up positions 15.

The vehicles 1 that are released and slowed down in the deceleration zone 8 are extracted by the sidings 17 from the normal path in the contour 9 in order to reach the drop-off and pick-up position 15 that is assigned thereto in order of arrival. The extracted vehicle is then stopped throughout the whole time necessary for the passengers to get on or off, and is then reinserted into the main path by the corresponding siding 17. The same vehicle takes the place freed up by an extracted vehicle according to an established program.

The compensation position 16 may advantageously be situated downstream of the main circuit of the contour 9, and in front of the acceleration zone 12 so that the reserve vehicle waiting in the compensation position 16 has the time to be inserted into the empty space caused by the vehicle that has not been able to depart on time.

FIGS. 4.0 to 4.47 illustrate the successive phases of a normal operation of the installation with vehicles A, B, C, D entering the downstream station, the vehicle E being the reserve vehicle in the compensation position 16, which is slightly offset downstream from the drop-off and pick-up positions 15. Each arriving vehicle A, B, C, D goes toward the drop-off/pick-up position 15 that has just been vacated, taking the place of the previous vehicle which is reinserted into the endless stream of vehicles after being stopped for a certain time at its drop-off/pick-up position 15.

Note that the reserve vehicle E remains permanently in place in the compensation position 16 throughout all the phases, given the regular timed operation of the other vehicles A, B, C, D of the installation both in the line and at stations. When they are released, the vehicles A, B, C, D are removed from the main path in the station, and rejoin the separate drop-off/pick-up positions 15, the preceding vehicle having previously been reincorporated into the slow path, in the place of an extracted vehicle. The example of FIGS. 4.0 to 4.47 shows two distinct drop-off/pick-up positions 15, but it is clear that the higher the number of drop-off/pick-up positions 15, the more time is allocated for dropping off/picking up.

The dropping off and picking up of passengers in the positions 15 take place when the vehicles A, B, C, D are stopped, and are controlled by sliding doors 21, 22, one door 21 being incorporated into each vehicle, and the other door 22 being arranged facing the position 15. The automatic operation of these doors 21, 22 will be described in detail below with reference to FIGS. 17 and 18.

FIGS. 5.0 to 5.47 represent the sequence of an exceptional operation of the system, when dropping off/picking up in a vehicle exceeds the time allocated thereto. It is the case of the vehicle B which remains stopped in its place of the drop-off/pick-up position 15, the other place of the drop-off/pick-up position 15 also being occupied normally by the vehicle C.

The vehicle A which arrives in the station (see FIGS. 5.0 to 5.7) cannot go to the position 15 that has been allocated thereto, because the preceding vehicle B which was to vacate the position and be reinserted into the endless stream of vehicles did not depart. The arriving vehicle A therefore goes to the compensation position 16 (see FIGS. 5.8 to 5.22), which the empty waiting reserve vehicle E which was parked there has just vacated, in order to fill the empty space in the endless stream of vehicles left by the stopped vehicle B. The vehicle A is therefore provisionally moved into the compensation position 16 (see FIGS. 5.23 to 5.47) where the passengers can get off. The empty vehicle A is then the reserve vehicle and the vehicle E reinserted into the line becomes one of the vehicles of the endless stream.

The vehicle B remains out of service at the position 15 until the phase of FIG. 5.16, the respective doors 21, 22 remaining open. The program established by the programmable controller allocates a new predetermined pick-up time to the vehicle B, and this time expires in the phase of FIG. 5.38. The doors 21, 22 of the vehicle B still remain open at this moment, and the programmable controller places it out of service for a new period (see FIGS. 5.39 to 5.47). Everything happens normally at the other adjacent position 15 where the vehicles C and D are taken out and reinserted according to the program established for maintaining the regularity of operation of the endless stream. The vehicle A also remains in reserve in the compensation position 16.

Figure 8:
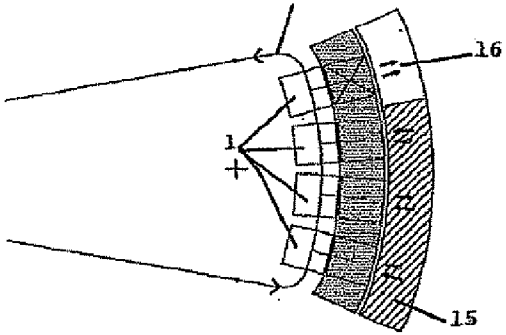
FIGS. 6-8 represent variants of an end station of an automatic installation shown in FIG. 3.
Figure 6:
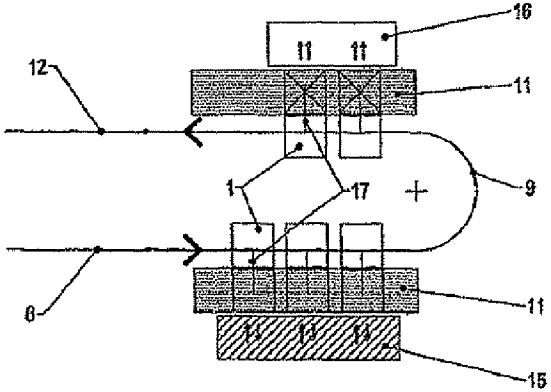
Figure 7:
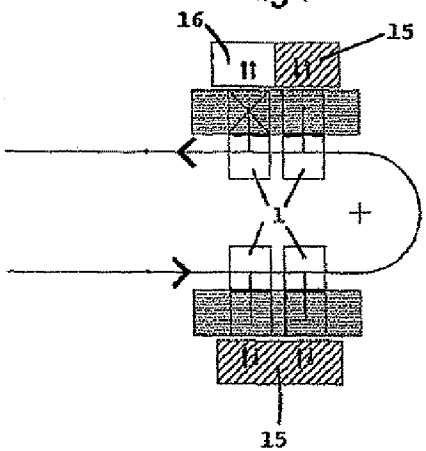

FIGS. 6 to 8 represent as examples the variants of FIG. 3, with drop-off/pick-up positions 15 and compensation position 16 with sidings 17 in end stations.

In FIG. 6, the drop-off/pick-up positions 15 and compensation position 16 extend in the rectilinear portions opposite to the released circuit, respectively upstream and downstream of the contour 9. The drop-off/pick-up position 15 is provided for three vehicles 1 of the endless stream, while the compensation position 16 on the branch opposite may receive two vehicles 1. The operation is identical to that of FIG. 3.

In FIG. 7, one of the drop-off/pick-up positions 15 of FIG. 6 replaces on the opposite side one of the places of the compensation position 16.

FIG. 8 illustrates the drop-off/pick-up positions 15 and compensation position 16 distributed side by side along the contour 9, the compensation position 16 still being placed downstream relative to the direction of travel of the vehicles 1.

Figure 9:
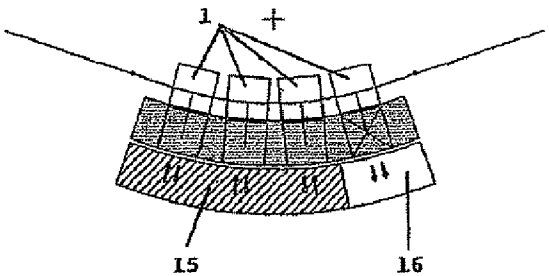
FIG. 9 illustrates the distribution of the drop-off/pick-up positions and compensation position for an intermediate station.

FIG. 9 represents the same distribution of the drop-off/pick-up positions 15 and compensation position 16 with sidings as FIG. 8, but for an intermediate station.

Figure 10:
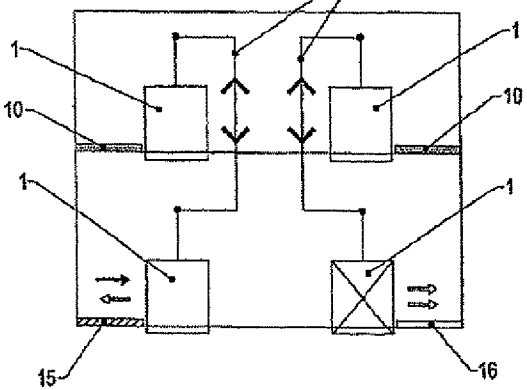
FIGS. 10 and 11 represent schematic views in section of an installation, wherein the maneuvering device consists of a set of respectively vertical and inclined elevators.
Figure 11:
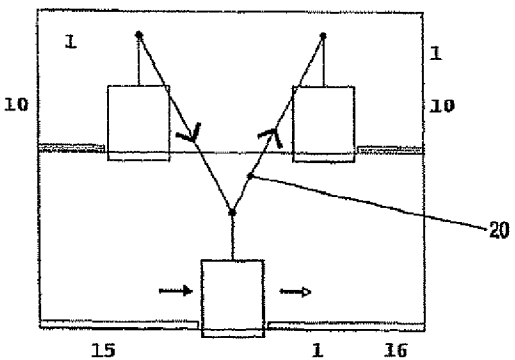

FIGS. 10 and 11 show schematic views in vertical section of a station in which the drop-off/pick-up positions 15 and compensation position 16 are at a different level relative to the platforms 10. The extraction and reinsertion of the released vehicles 1 is then carried out by vertical elevators 19 (FIG. 10) or inclined elevators 20 (FIG. 11).

FIGS. 12 to 15 represent various positions of end and intermediate stations, wherein the extraction and reinsertion of the released vehicles 1 are carried out thanks to level points 18. The compensation position(s) 16 is/are still placed downstream of the functional drop-off/pick-up positions 15, and there are still possibilities for platforms 10, 11, 14 allowing the return to a conventional operation of the cable car.

Figures 12, 13, 14, 15, 16:
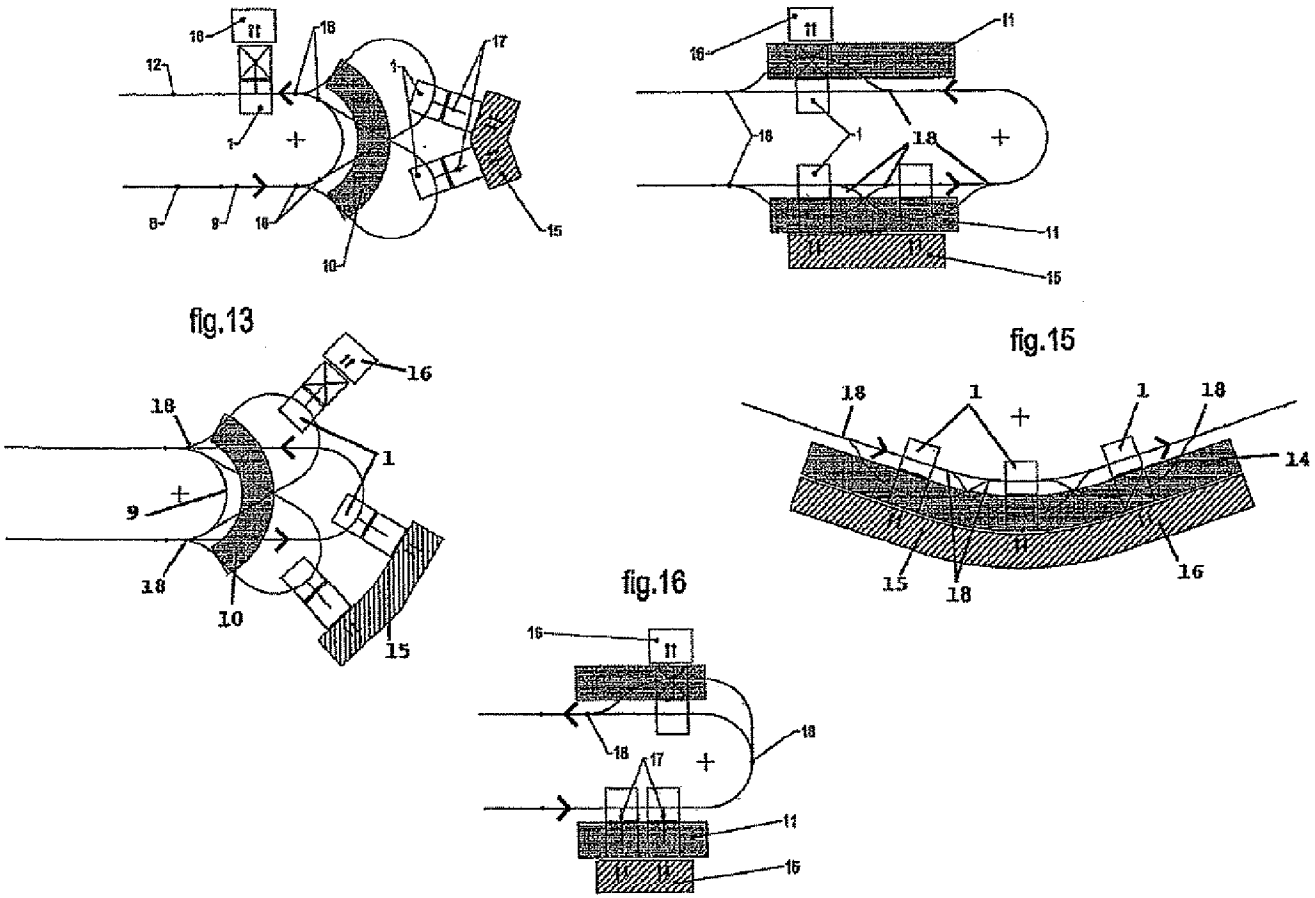
FIGS. 12 to 15 relate to various installations in which the maneuvering device consists of a set of points.
FIG. 16 relates to another installation with mixed use of sidings and points.

In FIG. 12, two drop-off/pick-up positions 15 are situated on two auxiliary tracks connected in parallel on the contour 9 by points 18. The compensation position 16 is situated in the released circuit just before the acceleration zone 12.

FIG. 13 shows three auxiliary tracks connected in parallel on the contour 9 by points 18. Two tracks are provided for two drop-off/pick-up positions 15, and the third is allocated to the compensation position 16 situated downstream.

FIG. 14 illustrates a position with points 18 with two opposite platforms 11 in an end station. The drop-off/pick-up position 15 on one of the platforms 11 is designed for two vehicles 1, and the compensation position 16 of the other platform 11 is designed for a reserve vehicle.

FIG. 15 is an arrangement comparable to that of FIG. 9 of an intermediate station, but making use of points 13 to divert and reinsert the vehicles 1 into the endless stream.

FIG. 16 is an arrangement comparable to FIG. 14, but in which the extraction and reinsertion of the released vehicles 1 for certain positions is carried out with the aid of a type of maneuvering device (siding, elevator, points), and for other positions with different types. The normal drop-off/pick-up positions 15 comprise sidings 17 on one side, and a compensation position 16 on the other side of the contour is fitted with points 18 with an auxiliary track.

Figure 17:
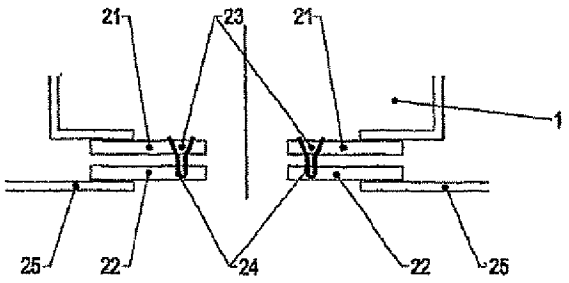
FIGS. 17 and 18 show respectively views in plan and in elevation of the system of opening and closing the landing doors.
Figure 18:
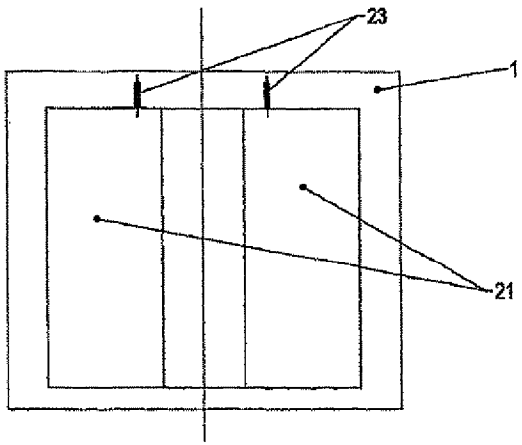

FIGS. 17 and 18 represent the system for automatic access to the vehicles 1 at the drop-off/pick-up positions 15. Each vehicle 1 is provided with a double door 21, and the drop-off/pick-up location of each position 15 comprises a landing door 22 that is also double. Lyre-shaped forks 24 are attached to the landing doors 22, and operate vertical pins 23 attached on the top of the doors 21 of the vehicles 1 in order to open and close them at given moments controlled by the programmable controller.

Irrespective of the adopted arrangement using sidings 17, elevators 19, 20 or points 18, provision may be made for the possibility of the existence of platforms 10, 11, 14 running alongside the main circuit of the released vehicles, in order to allow a conventional operation when the extraction systems are not used.

If the extraction system for the vehicles at the drop-off/pick-up positions 15 is horizontal (sidings, points), it involves platforms that can be moved vertically and raised after the disappearance of any vehicle from the drop-off/pick-up positions 15.

If the extraction system for the vehicles at the drop-off/pick-up positions 15 is vertical (elevators), these platforms may be designed to be unmovable.

The invention claimed is:

1. An automatic installation for cable transport along a closed loop line, said closed loop line comprising a cable at least two stations along said closed loop line, a plurality of vehicles to be moved along the cable of said closed loop line, wherein each station comprises:

an entry decoupling track, the entry decoupling track being adapted to decouple the vehicles from the cable, a slow path released circuit, the slow path released circuit being adapted to advance the vehicles in a staged movement in the station at a slow speed, drop-off and pick-up positions, an automatic maneuvering mechanism, the automatic maneuvering mechanism being adapted to extract a vehicle from the slow path released circuit and to transfer the vehicle to a drop-off and pick-up position or a compensation position that is assigned to the vehicle in order of arrival, and an exit coupling track, the exit coupling track being adapted to reaccelerate the vehicles and to recouple them to the cable at an exit of the station in order to constitute an endless stream of vehicles, wherein said automatic maneuvering mechanism has previously reincorporated a previous vehicle into the released circuit in place of the extracted vehicle according to an established program, wherein said automatic maneuvering mechanism has previously stored an empty vehicle in said compensation position and transfers said empty vehicle into said released circuit according to an established program in the event of a timing fault, and wherein the slow path released circuit is adapted to advance the vehicles in the staged movement along the drop-off and pick-up positions.

2. The automatic transport installation as claimed in claim 1, wherein the maneuvering mechanism is fitted with horizontal actuation sidings to allow the vehicles to be moved outside the slow path released circuit in a direction perpendicular to the direction of travel of the endless stream in the slow path.

3. The automatic transport installation as claimed in claim 2, wherein emergency platforms are provided along the released circuit of path of the released vehicles movable by lifting after the disappearance of any vehicle in the drop-off and pick-up positions.

4. The automatic transport installation as claimed in claim 1, wherein the maneuvering mechanism comprises vertical or inclined elevators to allow the vehicles to be moved outside the slow path released circuit towards the drop-off and pick-up positions and compensation positions arranged at a level different from the released circuit.

5. The automatic transport installation as claimed in claim 4, wherein the platforms are permanently placed along the circuit of path of the released vehicles by being situated at a different level relative to the drop-off and pick-up positions and compensation positions.

6. The automatic transport installation as claimed in claim 1, wherein the maneuvering mechanism comprises level track switches for diverting and reinserting the vehicles into the slow path released circuit via auxiliary tracks.

7. The automatic transport installation as claimed in claim 1, wherein the compensation position is provided only for the drop-off of passengers from a vehicle that would have had to go to the drop-off and pick-up position occupied by another delayed vehicle that has not been able to be reinserted in its place in time.

8. The automatic transport installation as claimed in claim 7, wherein the maneuvering mechanism comprises level track switches for diverting and reinserting the vehicles into the slow path released circuit via auxiliary tracks.

9. The automatic transport installation as claimed in claim 1, wherein platforms along the released circuit of path of the released vehicles are movable by lifting after the disappearance of any vehicle in the drop-off and pick-up positions.

10. The automatic transport installation as claimed in claim 1, wherein a number of compensation positions provided is less than or equal to that of the drop-off and pick-up positions.

11. The automatic transport installation as claimed in claim 10, wherein the compensation positions are situated downstream of the drop-off and pick-up positions relative to the direction of the released circuit of the vehicles.

12. The automatic transport installation as claimed in claim 1, wherein the drop-off/pick-up of the passengers is carried out when stopped, each vehicle stopping at its drop-off and pick-up position in front of a platform, which is furnished with a landing door placed opposite the door of the vehicle that is stopped.

13. The automatic transport installation as claimed in claim 12, wherein the opening and closing of the doors of the vehicles and of the landing doors is automatic and simultaneous.

14. The automatic transport installation as claimed in claim 13, wherein the landing doors each comprise a fork for operating a pin attached to the top of the doors of the vehicles in order to open and close them automatically.

15. The automatic transport installation as claimed in claim 1, wherein no fixed drop-off and pick-up positions are provided along the slow path released circuit.

* * * * *